US005794544A

United States Patent [19]

Shuert

[11] Patent Number: 5,794,544

[45] Date of Patent: Aug. 18, 1998

[54] PLASTIC PALLET

[76] Inventor: Lyle H. Shuert, 70 Kingsley Manor Dr., Bloomfield Hills, Mich. 48304

[21] Appl. No.: 858,325

[22] Filed: May 19, 1997

Related U.S. Application Data

[63] Continuation of Ser. No. 636,062, Apr. 22, 1996, abandoned.

[51] Int. Cl.[6] ..... B65D 19/00

[52] U.S. Cl. ..... 108/57.25; 108/901

[58] Field of Search ..... 108/51.1, 56.1, 108/56.3, 901, 902, 57.25, 57.28, 57.27, 51.11

[56] References Cited

U.S. PATENT DOCUMENTS

| | | | |
|---|---|---|---|
| 2,486,284 | 10/1949 | Horwitz . | |
| 3,467,032 | 9/1969 | Rowlands et al. . | |
| 3,604,368 | 9/1971 | Baxler . | |
| 3,610,173 | 10/1971 | McIlwraith et al. . | |
| 3,664,271 | 5/1972 | Wolder et al. | 108/901 X |
| 3,667,403 | 6/1972 | Angelbert, Jr. . | |
| 3,680,486 | 8/1972 | Westlake, Jr. | 108/901 X |
| 3,691,964 | 9/1972 | Loason et al. . | |
| 3,697,029 | 10/1972 | Lauffer . | |
| 3,699,902 | 10/1972 | Allgeyer et al. . | |
| 3,868,915 | 3/1975 | Hafner | 108/901 X |
| 4,013,021 | 3/1977 | Steinlein et al. | 108/901 X |
| 4,183,491 | 1/1980 | Sanders et al. | 108/901 X |
| 5,117,762 | 6/1992 | Shuert . | |
| 5,255,613 | 10/1993 | Shuert . | |
| 5,351,629 | 10/1994 | Breezer et al. | 108/56.3 |
| 5,401,347 | 3/1995 | Shuert | 108/901 X |
| 5,497,709 | 3/1996 | Gonzalez et al. | 108/902 X |

FOREIGN PATENT DOCUMENTS

| | | | |
|---|---|---|---|
| 226505 | 11/1986 | European Pat. Off. . | |
| 2101346 | 3/1972 | France | 108/902 |
| 2013618 | 8/1979 | United Kingdom | 108/901 |

*Primary Examiner*—Jose V. Chen
*Attorney, Agent, or Firm*—Young & Basile, P.C.

[57] ABSTRACT

A plastic pallet comprising a generally planar platform structure defining an upper face, providing an article support surface, and an underface; a generally planar base structure defining a lower pallet support face and an upper face; and a plurality of hollow legs of closed box configuration positioned between the platform and base structures and each including an upper wall structure fused to the underface of the platform structure and a lower wall structure fused to the upper face of the base structure. The platform structure and base structure are each of twin sheet configuration and each includes an upper sheet and a lower sheet selectively fused together to form the respective structure. Pockets are provided in the lower sheet of the platform structure to receive the upper ends of the box legs and pockets are provided in the upper sheet of the base structure to receive the lower ends of the box legs. Each leg is formed from first and second thermoformed plastic parts fused together along a generally vertical seam line. The upper end of each leg is recessed in an inboard direction to allow access to a downwardly opening groove defined around the perimeter of the platform structure by a downwardly extending peripheral lip.

11 Claims, 8 Drawing Sheets

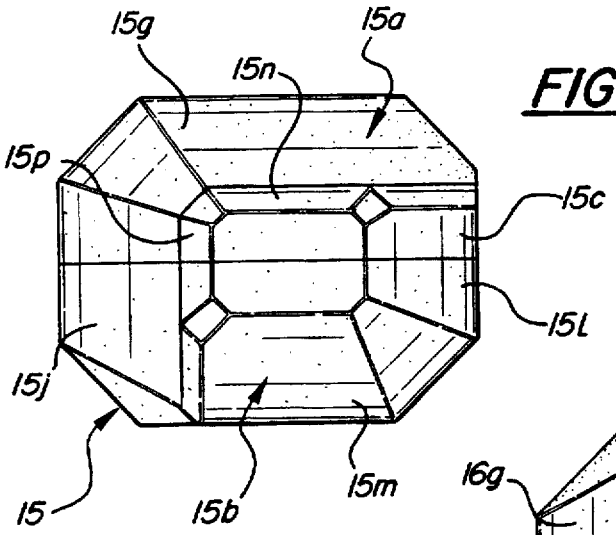
FIG-8
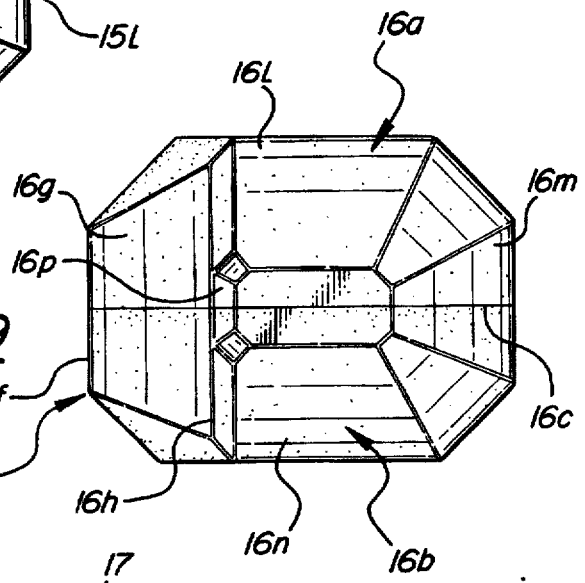
FIG-9
FIG-11
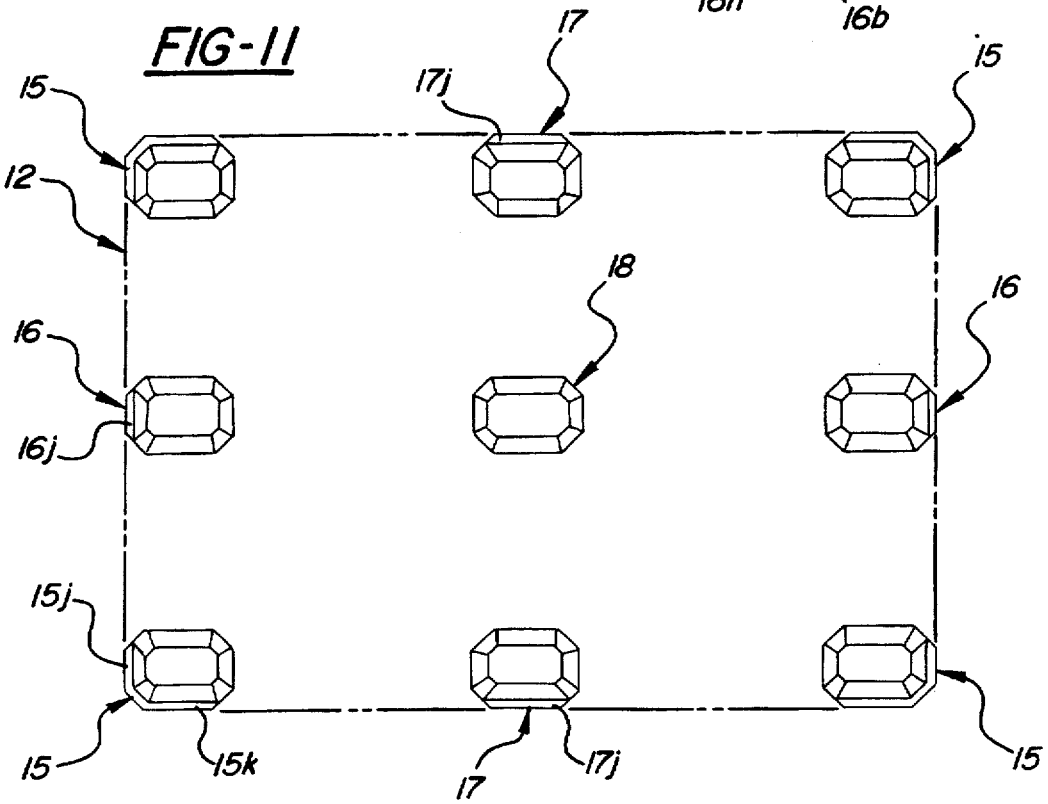

PLASTIC PALLET

This is a continuation of application Ser. No. 08/636,062 filed on Apr. 22, 1996, now abandoned.

BACKGROUND OF THE INVENTION

This invention relates to pallets and more particularly to plastic pallets.

Pallets have traditionally been formed of wood. Wood pallets, however, have many disadvantages. For example, they are subject to breakage and thus are not reusable over an extended period of time. In an effort to solve some of the problems associated with wood pallets, plastic pallets have been developed and employed with some degree of success. In one generally successful form of plastic pallet design, upper and lower plastic sheets are formed in separate molding operations and the two sheets are then selectively fused or knitted together in a suitable press to form reinforced double wall or "twin sheet" structures.

Plastic twin sheet pallets of this general type are shown, for example, in U.S. Pat. Nos. 4,550,830; 4,606,278; 4,742,781; 4,765,252; 4,856,657; 4,879,956; 4,936,451; 4,989,731; 5,042,396; 5,117,762; 5,133,460; 5,255,613; 5,390,467; 5,401,347; 5,404,829; and 5,279,423 all invented by the inventor of the present application. Whereas the twin sheet plastic pallets disclosed in these patents have been generally satisfactory, they in general must be fabricated utilizing a mold apparatus that is dedicated to the production of a single pallet configuration, and their construction limits the ability to separately optimize the strength and other characteristics of the various portions of the pallet.

SUMMARY OF THE INVENTION

This invention is directed to the provision of an improved plastic pallet.

More specifically, this invention is directed to the provision of a plastic pallet providing high strength in shear as well as in compression.

This invention is further directed to the provision of an improved double face plastic pallet.

The invention pallet is of the type including a planar plastic platform structure and a plurality of plastic legs supporting the platform structure. According to the invention, a plurality of spaced downwardly opening pockets are provided in a lower face of the platform structure; each leg has a hollow closed box configuration and includes an upper wall structure; and the upper wall structure of each leg is fitted into a respective pocket and is fused to the plastic material of the platform structure defining the pocket. This arrangement provides a pallet which may be inexpensively produced and which allows a range of pallet configurations to be produced from a single platform structure simply by varying the characteristics of the legs that are fused to the platform structure.

According to a further feature of the invention, the upper wall structure of each leg has a size and shape corresponding to the size and shape of the respective pocket so as to fit snugly within that pocket. This arrangement provides a positive securement as between the platform structure and the leg and optimizes the shear strength of the pallet.

According to a further feature of the invention, the platform structure comprises a twin sheet structure formed of upper and lower thermoformed plastic sheets selectively fused together and the pockets are formed in the lower plastic sheet. This specific construction provides a ready and convenient means of providing the pockets for receipt of the legs.

According to a further feature of the invention, each leg is formed from first and second thermoformed plastic parts fused together. This arrangement provides a ready and inexpensive means of providing the legs.

According to a further feature of the invention, the plastic parts of each leg are fused together along a seam line lying in a generally vertical plan. This arrangement facilitates ready assembly of the legs and provides excellent leg strength.

According to a further feature of the invention, the pallet further includes a base structure; a plurality of upwardly spaced opening pockets are provided in an upper face of the base structure; and each leg includes a lower wall structure having a size and shape corresponding to the size and shape of a respective base structure pocket, is received in that pocket, and is fused to the plastic material of the base structure defining that pocket. This arrangement provides a convenient and inexpensive means of providing a double face pallet having excellent strength characteristics and excellent versatility.

According to a further feature of the invention, the base structure comprises a twin sheet structure formed of upper and lower thermoformed sheets selectively fused together and the upwardly opening pockets are formed in the upper plastic sheet. This arrangement provides a ready and efficient means of providing the upwardly opening pockets.

The invention further provides an improved double face plastic pallet including a generally planar platform structure defining an upper face providing an article support surface and an underface; a generally planar base structure defining a lower pallet support face and an upper face; and a plurality of hollow legs of closed box configuration positioned between the platform and base structures and each including an upper wall structure fused to the underface of the platform structure and a lower wall structure fused to the upper face of the base structure. This arrangement provides a double face plastic pallet providing high strength, inexpensive manufacture, and versatility.

BRIEF DESCRIPTION OF THE DRAWINGS

FIGS. 8 and 9 are top views of legs employed in the invention pallet;

FIG. 11 is a composite bottom view of the legs;

DETAILED DESCRIPTION OF THE PREFERRED EMBODIMENT

Figure 1:
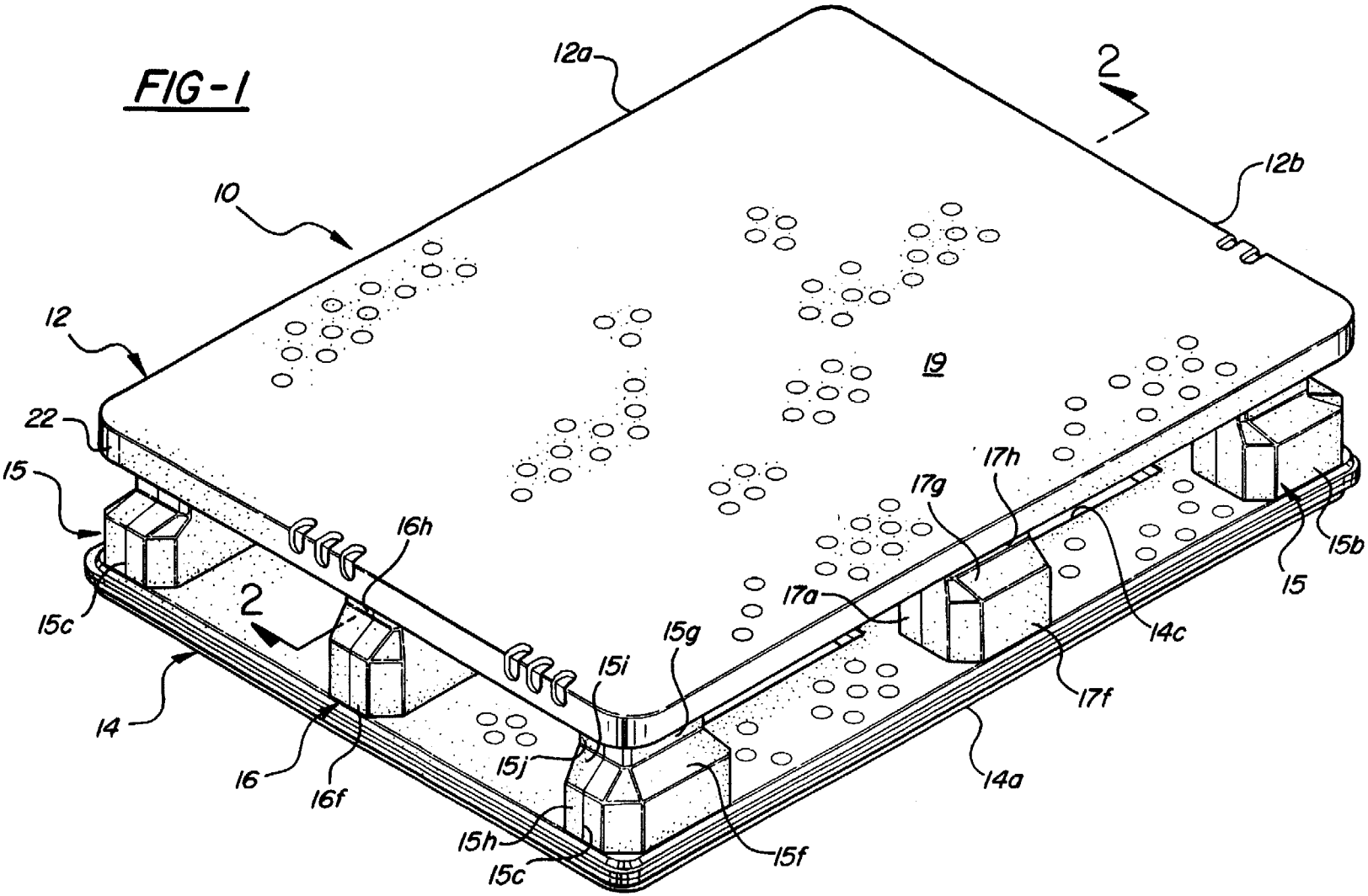
FIG. 1 is a perspective view of a twin sheet plastic pallet according to the invention including a base structure, a platform structure, and a plurality of legs interposed between the base and platform structures.
Figure 2:
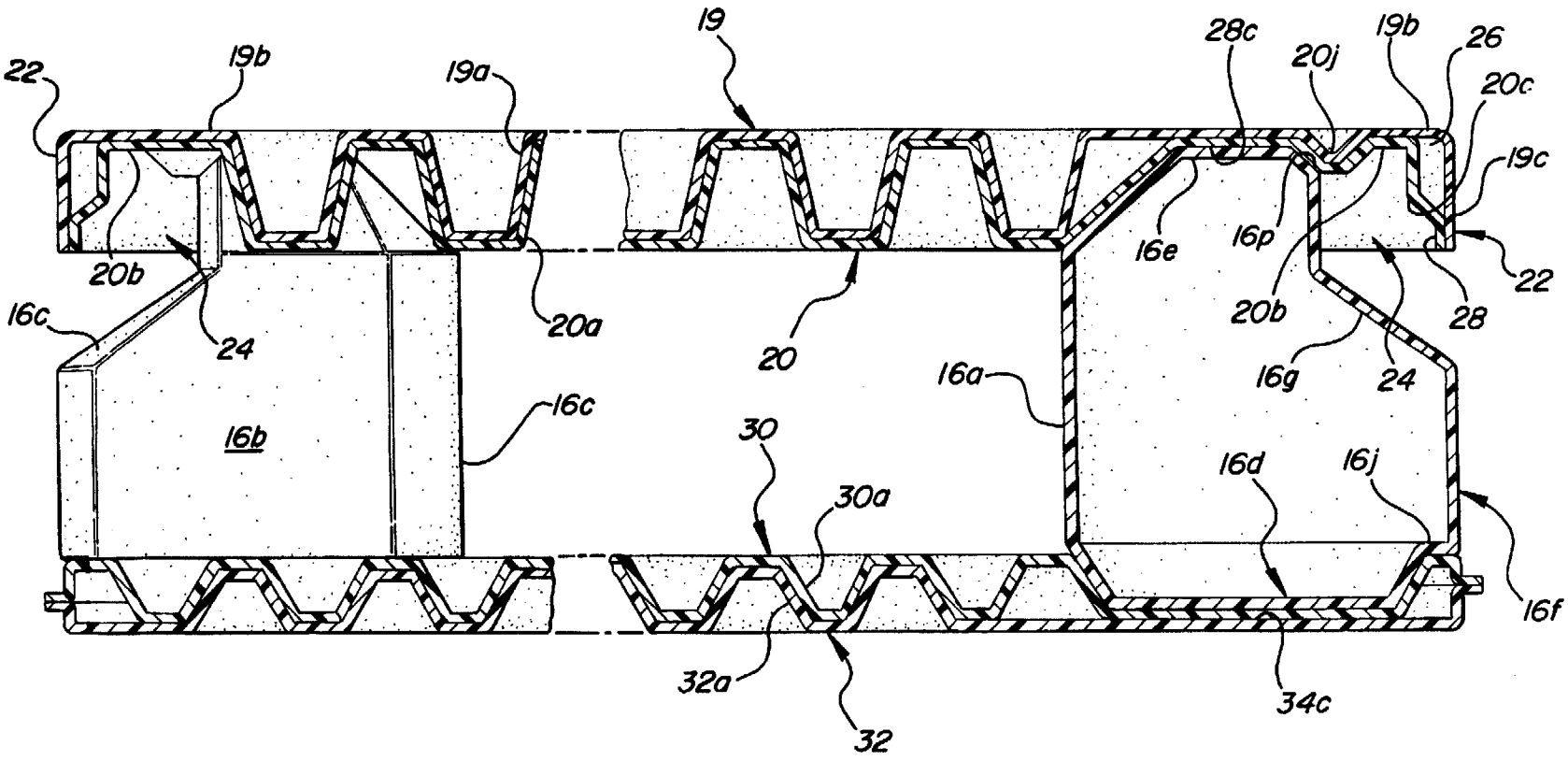
FIG. 2 is a fragmentary cross-sectional view taken on line 2—2 of FIG. 1.
Figure 3:
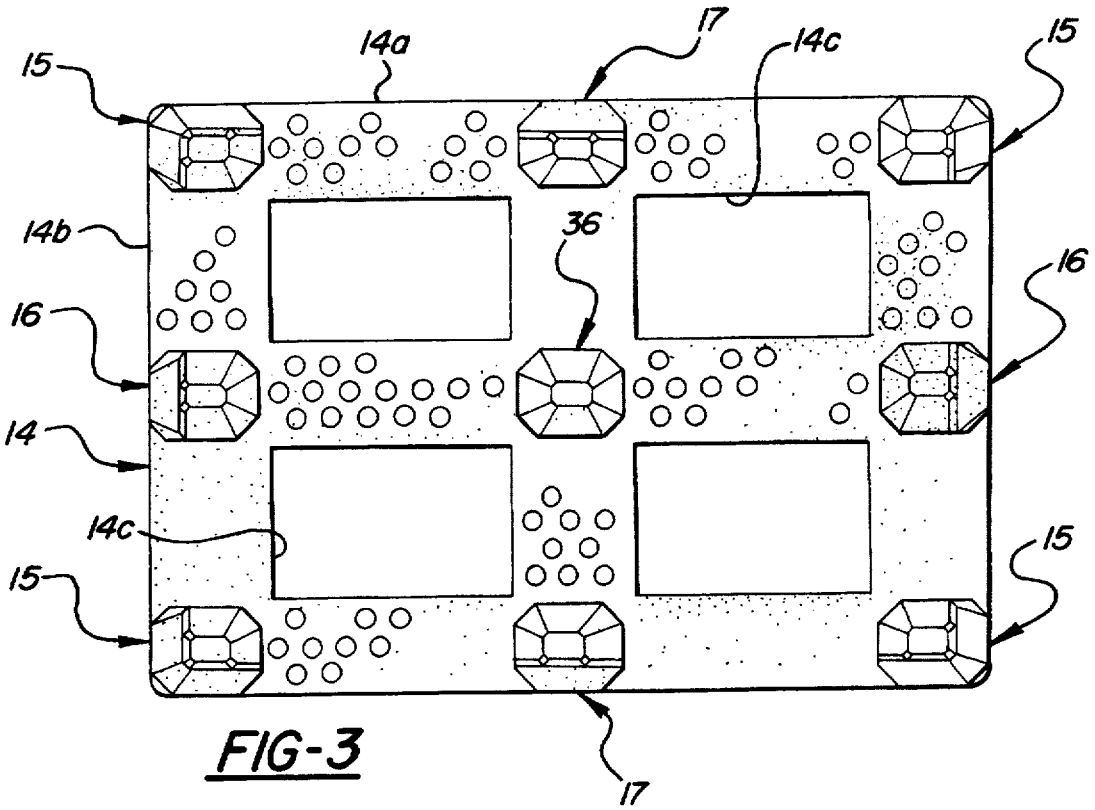
FIG. 3 is a plan view of the pallet with the platform structure removed.
Figure 4:
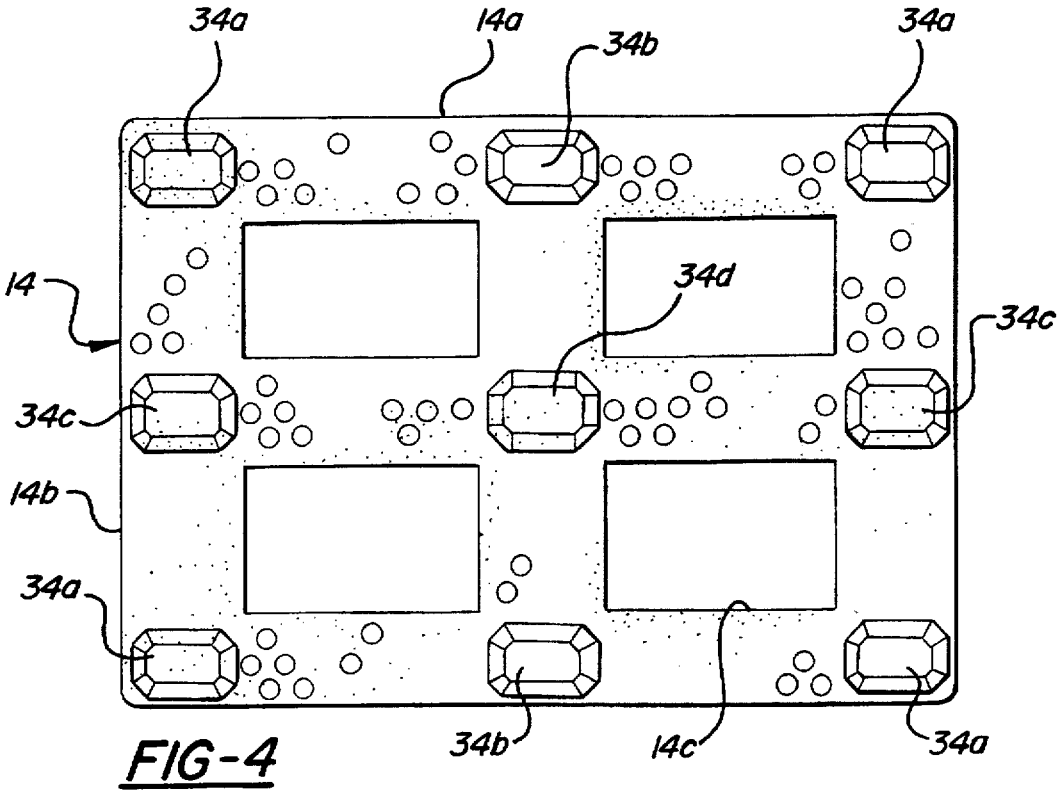
FIG. 4 is a plan view of the base structure.
Figure 5:
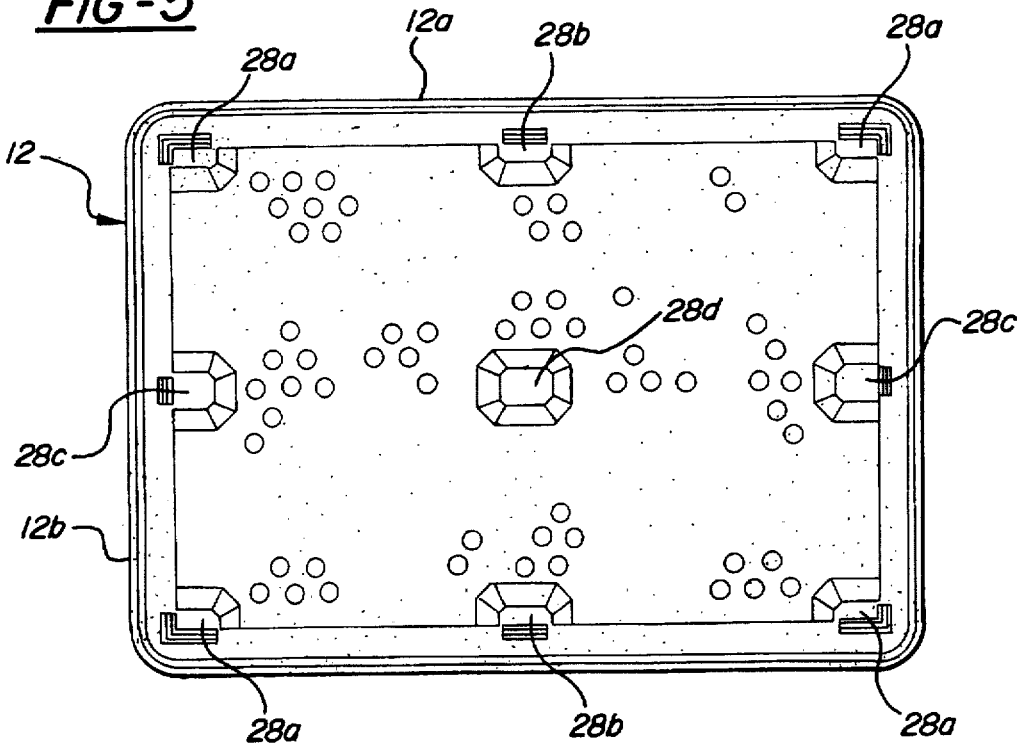
FIG. 5 is a bottom plan view of the platform structure.
Figure 7:
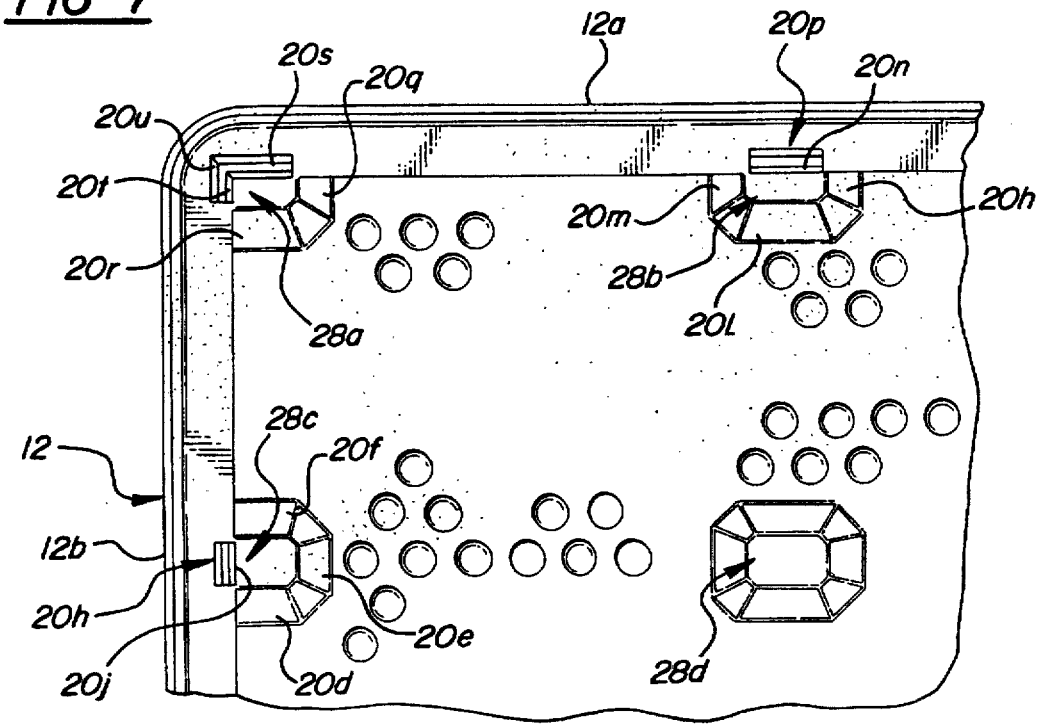
FIG. 7 is a fragmentary bottom plan view of the platform structure.
Figure 6:
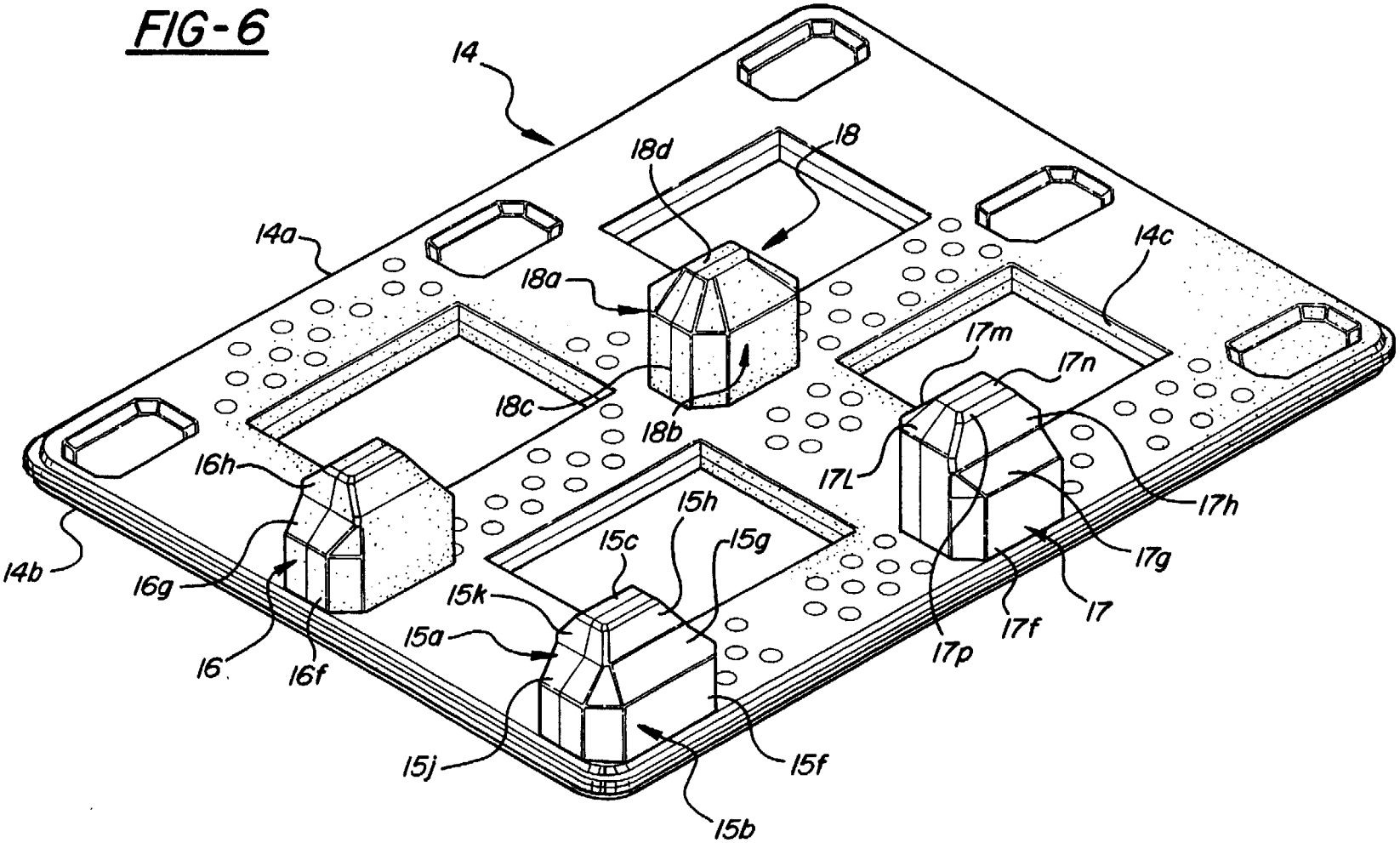
FIG. 6 is a perspective view showing the base structure and some of the legs.

The pallet 10 seen in FIG. 1 is a double faced pallet of twin sheet construction. Specifically, pallet 10 includes an upper platform structure 12, a lower base structure 14, and a plurality of modular legs 15, 16, 17, and 18 interconnecting the platform structure and the base structure. Platform structure 12, base structure 14, and legs 15–18 are formed of organic polymeric material such as polyethylene. Platform structure 12 and base structure 14 preferably are of a twin sheet construction employing two plastic sheets which are vacuum formed and fused or knitted together at various points to add structural rigidity.

Platform structure 12 is formed of an upper plastic sheet 19 and a lower plastic sheet 20. Upper sheet 19 has a series of rows of downwardly extending bosses 19*a* and lower sheet 20 has a series of rows of upwardly extending bosses 20*a*. The downwardly extending and upwardly extending rows of bosses are arranged in interdigitated fashion and fused together at the interface of the interdigitated bosses to form rows of boss columns. The rows of columns may for example extend parallel to the longitudinal and transverse side edges 12*a*, 12*b* of the platform structure. Further details of the manner in which the bosses of the upper and lower sheets are fused together to form the column structures are shown in U.S. Pat. Nos. 5,390,467, 5,401,347 and 5,470,641 and in U.S. patent application Ser. No. 08/426,876 filed on Apr. 24, 1995.

The peripheral edges 19*b* and 20*b* of the upper and lower sheets are fused together to define a downwardly extending peripheral lip 22 defining a downwardly opening groove 24 extending totally around the periphery of the platform structure. Lip 22 is formed by bringing peripheral edge portion 20*b* of the lower sheet upwardly into proximity with the peripheral edge portion 19*b* of the lower sheet and bending the sheet edge portions downwardly together. Lip 22 is constituted by a downwardly extending outer edge portion 20*c* of lower sheet 20 and a downwardly extending outer edge portion 19*c* of upper sheet 19. Edge portions 19*c*, 20*c* are selectively spaced apart proximate their upper regions to define circumferentially spaced voids 26 therebetween for structural rigidity and are continuously fused together adjacent their lower regions at an interface 28.

Upper and lower sheets 19, 20 are also configured at circumferentially spaced locations around the periphery of the platform structure to define downwardly opening recesses or pockets 28 to receive respective legs 15, 16, 17, and 18. Specifically, corner pockets 28*a* are defined at each corner of the platform structure; longitudinal side pockets 28*b* are defined along each longitudinal side edge 12*a* of the platform structure; lateral side pockets 28*c* are defined along each lateral side edge 12*b* of the platform structure; and a central pocket 28*d* is defined in a central portion of the platform structure.

Base structure 14 is formed of upper and lower plastic sheets 30, 32 respectively defining downwardly extending rows of bosses 30*a* and upwardly extending rows of bosses 32*a* which are interdigitally arranged and fused together at their interdigitated interfaces to form rows of columns similar to the rows of columns in the platform structure but arranged in rows extending generally parallel to the longitudinal and transverse side edges 14*a* and 14*b* of the base structure. Base structure 14 may comprise a single, continuous structure or may, as shown, include cutouts 14*c* to give the base structure an open grate configuration.

Upper sheet 30 is further configured to define upwardly opening recesses or pockets 34 corresponding in number and circumferential disposition to the downwardly opening pockets 28 in the platform structure and arranged to receive the lower ends of legs 15–18. Specifically, corner pockets 34*a* are defined at each corner of the base structure; longitudinal side pockets 34*b* are defined along each longitudinal side edge 14*a* of the base structure; lateral side pockets 34*c* are defined along each lateral side edge 14*b* of the base structure; and a central pocket 34*d* is defined in a central region of the base structure.

Legs 15–18 are of a modular closed box construction and each includes a left half 15*a*, 16*a*, 17*a*, and 18*a* and a right half 15*b*, 16*b*, 17*b* and 18*b* fused together along a respective fuse or seam line 15*c*, 16*c*, 17*c*, and 18*c*. The lower end of each leg 15 is configured to nest or seat within a respective base structure pocket 34*a*; the upper end of each leg 15 is configured to nest or seat within a respective platform structure corner pocket 28*a*; the lower end of each leg 16 is configured to nest within a respective base structure lateral side edge pocket 34*c*; the upper end of each leg 16 is configured to nest within a respective platform structure lateral side pocket 28*c*; the lower end of each leg 17 is configured to nest within a respective base structure lateral side pocket 34*b*; the upper end of each leg 17 is configured to nest within a respective platform structure lateral side pocket 28*b*; and the upper and lower ends of leg 18 are configured to seat respectively in pockets 28*d*, 34*d*.

The outboard wall 16*f* of each leg 16 is stepped inwardly at 16*g* to define a recessed upper wall portion 16*h* which is stepped inwardly with respect to lip 22 so as not to encroach upon groove 24 and not to interfere with access to groove 24. The outboard wall 17*f* of each leg 17 is stepped inwardly at 17*g* to define a recessed upper wall portion 17*h* which is stepped inwardly with respect to lip 22 so as not to encroach upon groove 24 and so as not to interfere with access to groove 24. The longitudinal outboard face 15*f* of each leg 15 is stepped inwardly at 15*g* to define an upper recessed wall portion 15*h* spaced inwardly from lip 22 so as not to encroach on groove 24 and the transverse outboard face 15*i* of each leg 15 is stepped inwardly at 15*j* to define a recessed upper wall portion 15*k* spaced inwardly with respect to lip 22 so as not to encroach upon groove 24. Central leg 18 extends between central pockets 28*d* and 38*d* to support the central region of the pallet. The upper ends of the legs 15, 16, 17, and 18 are fused in position within the respective upper pockets 28 and the lower ends of the legs 15, 16, 17, and 18 are fused in position in the respective lower pockets 34. The inwardly stepped configuration of the legs will be seen to avoid encroachment of the upper ends of the legs with groove 24 so as to not impede access to the groove 24 at any point around the circumference of the platform structure.

The pockets 34*a*–34*d* in the upper face of base structure 14 have an essentially identical rectangular bevelled configuration in the manner of a truncated pyramid, and each of the legs 15–18 has a rectangular bevelled footprint of a truncated pyramidal configuration sized to nest snugly in a respective pocket 34. In addition, the outer legs 15–17 have ledge structures to enable the outboard faces of the legs to be positioned essentially flush with the outer perimeter of the base structure. Specifically, legs 17 have ledges 17*j* adapted to rest on the upper face of sheet 30 outboard of the longitudinal edge of the respective pocket 34*b*; legs 16 have ledges 16*j* adapted to rest on the upper face of sheet 30 outboard of the transverse edge of a respective pocket 34*c*; and corner legs 15 have ledges 15*j* and 15*k* adapted to rest on the upper face of sheet 30 outboard of the longitudinal and transverse edges of the respective pocket 34*a*.

The upper ends of legs 15–18 have varying profiles and the respective platform structure pockets 28*a*–28*d* have shapes and configurations adapted to individually and firmly accommodate the upper ends of the respective legs.

Specifically, the upper end 18*d* of central leg 18 has a simple truncated pyramidal configuration and seats in a central pocket 28*d* of corresponding size and configuration; the upper end of each transverse side leg 16 seats in a respective pocket 28*c* and includes large area bevelled surfaces 16*l*, 16*m*, and 16*n* seating against large area bevelled pocket surfaces 20*d*, 20*e*, and 20*f* defined by the platform structure lower sheet 20 and further includes a small area bevelled surface 16*p* seating against a small area bevelled surface 20*j* defined on the inboard face of a ridge 20*h* formed in platform structure lower sheet 20; the upper end of each longitudinal side leg 17 seats in a respective pocket 28*b* and includes large area bevelled surfaces 17*l*, 17*m*, and 17*n* seated against large area bevelled pocket surfaces 20*k*, 20*l*, and 20*m* and further includes a small area bevelled surface 17*p* seating against a small area bevelled surface 20*n* defined on the inboard face of a ridge 20*p* formed in platform structure lower sheet 20; and the upper end of each corner leg 15 seats in a respective pocket 28*a* and includes large area bevelled surfaces 15*l* and 15*m* seating against large area bevelled pocket surfaces 20*q* and 20*r* and further includes small area bevelled surfaces 15*n* and 15*p* seating against small area bevelled surfaces 20*s* and 20*t* defined on the inboard faces of a right angle ridge 20*u* formed in platform structure lower sheet 20.

It will be understood that, in the completed pallet, the upper and lower ends of the legs are positioned in the respective pockets in the platform structure and in the base structure and the plastic material of the legs is fused to the plastic material of the platform structure and base structure at the interfaces between the various surfaces on the upper and lower ends of the legs and the various surfaces defining the pockets.

Figure 13:
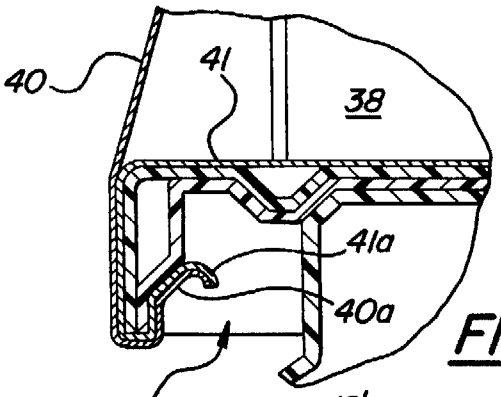
FIG. 13 is a detail view taken within circle 13 of FIG. 12.
Figure 12:
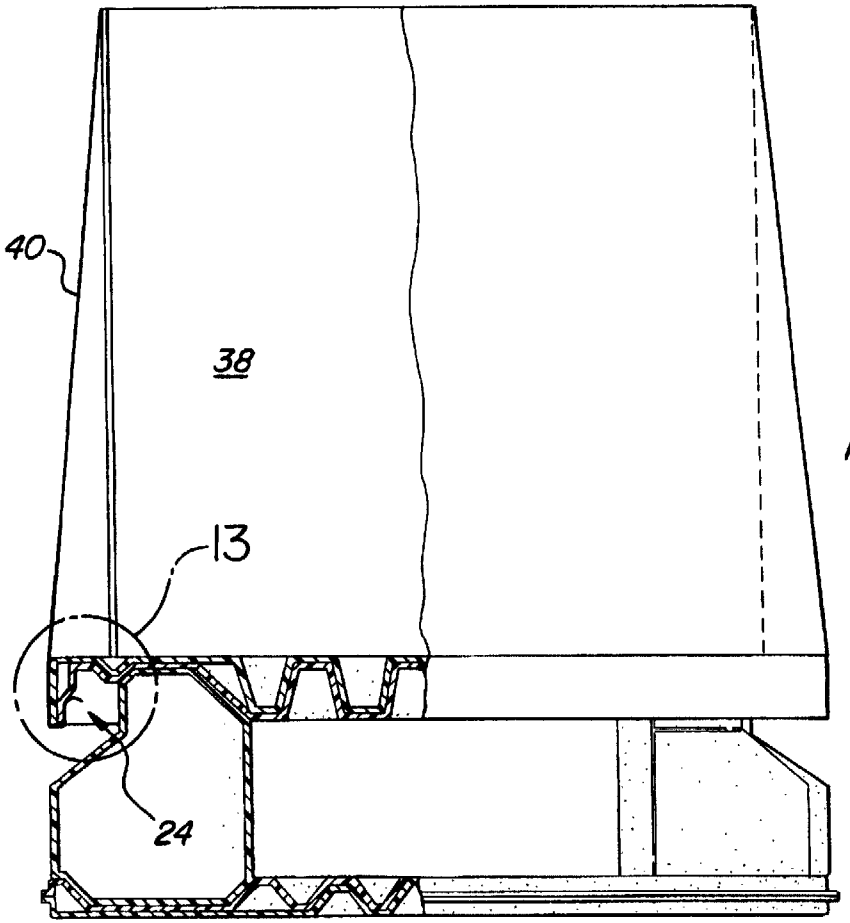
FIG. 12 is a side elevational view showing the utilization of the invention pallet in a shrink-wrapping methodology.

FIGS. 12 and 13 illustrate the manner in which the invention pallet is utilized to facilitate the shrink-wrapping of an article such as the article 38 positioned on the upper face of the platform structure. Specifically, article 38 is shrink-wrapped in position on the platform structure 12 utilizing a plastic film sheet 40 of bag configuration which is positioned in covering relation over the article whereafter its lower peripheral edge 40*a* is tucked upwardly into the downwardly opening groove 24 so as to firmly secure the lower edge 40*a* of the film sheet to the platform structure and preclude inadvertent separation of the film sheet from the platform structure and inadvertent exposure of the article. If desired, and as shown in FIG. 13, a flat sanitizing film sheet 41 may be positioned over the platform structure prior to placement of the article 38 on the platform structure, whereafter article 38 may be placed on the platform structure over film sheet 41, bag sheet 40 may be fitted over the article, and the lower peripheral edges 40*a* and 41*a* of the bag film and the flat film may be tucked upwardly together into the downwardly opening groove 24.

Figures 10, 15:
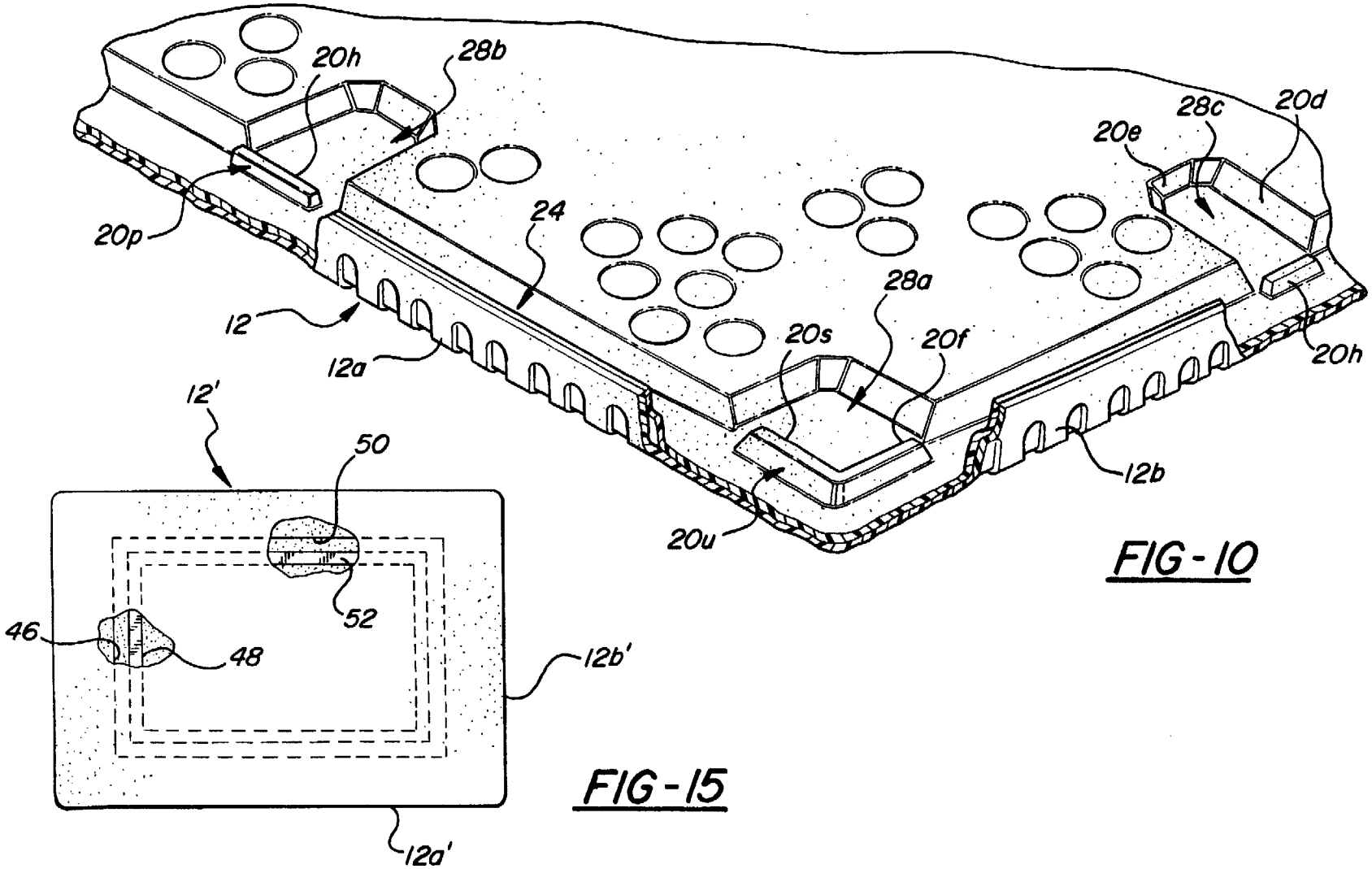
FIG. 10 is a bottom fragmentary perspective view of the platform structure.
FIG. 15 is a plan view of the modified pallet of FIG. 14.
Figure 14:
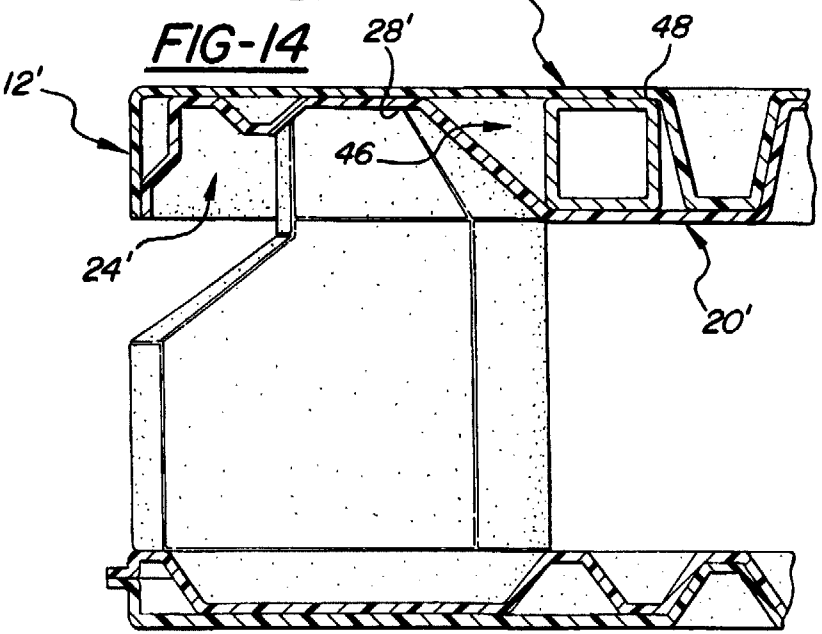
FIG. 14 is a fragmentary detail view showing a modified form of the invention pallet.

In the modified form of the pallet seen in FIGS. 14 and 15, the upper and lower sheets 19' and 20' of the platform structure 12' are configured to define laterally extending cavities 42 positioned inboard of the leg pockets 28' and extending parallel to the platform structure lateral side edges 12*b*', and a tubular steel beam 48 is positioned in each cavity 42 to add structural rigidity to the platform structure and to the pallet. Preferably the upper and lower sheets are further configured to provide longitudinal cavities 50 extending parallel to the platform structure longitudinal side edges 12*a*' inboard of leg pockets 28' and longitudinally extending tubular steel beams 52 are positioned in the cavities 50 so as to coact with the beams 48 to define a rectangular beam structure extending around the perimeter of the platform structure inboard of the legs.

The described pallet structure provides an inexpensive pallet construction; allows a single platform structure and/or base structure to be utilized with various size legs to provide a range of pallet configurations; provides excellent compressive strength by virtue of the closed box configuration of the legs; provides excellent shear strength in both primary directions by virtue of the pocket side walls capturing the upper and lower ends of the legs; and provides an unimpeded downwardly opening groove around the entire perimeter of the platform structure to facilitate shrink wrapping of articles on the pallet.

Whereas preferred embodiments of the invention have been illustrated and described in detail, it will be apparent that various changes may be made in the disclosed embodiments without departing from the scope or spirit of the invention.

I claim:

1. A plastic pallet comprising:

a generally planar platform structure comprising an upper plastic sheet, defining a platform surface for the pallet, and a lower plastic sheet positioned in spaced relation beneath the upper sheet, selectively fused to the upper sheet, and defining a plurality of spaced downwardly opening pockets with each pocket including a base surface portion and sidewall surface portions in surrounding relation to the base surface portion; and a plurality of plastic legs positioned beneath the platform structure in respective proximity to the pockets, each leg having a hollow closed box configuration and including an upper wall structure having a base surface portion having a size and shape corresponding to the size and shape of the base surface portion of a respective pocket and sidewall surface portions having a size and shape corresponding to the size and shape of the sidewall surface portions of the respective pocket, each upper wall structure being seated in a respective pocket and being fused to the plastic material of the lower sheet defining that pocket at the interfaces of the base surface portions and the sidewall surface portions, the base and sidewall surface portions of the respective pockets coacting with the base and sidewall surface portions of the respective leg upper wall structures to rigidly secure the legs to the underface of the platform structure to preclude sliding displacement of the legs relative to the platform structure in response to shearing stress forces.

2. A plastic pallet according to claim 1 wherein each leg is formed from first and second thermoformed plastic parts fused together.

3. A plastic pallet according to claim 2 wherein the plastic parts of each leg are fused together along a seam lying in a generally vertical plane.

4. A plastic pallet according to claim 1 wherein:

the pallet further includes a generally planar plastic base structure;

a plurality of spaced upwardly opening pockets are provided in an upper face of the base structure; and each leg includes a lower wall structure having a size and shape corresponding to the size and shape of a respective upwardly opening pocket, is received in that pocket, and is fused to the plastic material of the base structure defining that pocket.

5. A plastic pallet according to claim 4 wherein:

the base structure comprises a twin sheet structure formed of upper and lower thermoformed sheets selectively fused together; and the upwardly opening pockets are formed in the upper plastic sheet.

6. A plastic pallet according to claim 1 wherein the side wall surface portions of the pockets and of the leg upper wall structures have a complementary beveled configuration so that the interfaces of the fused pocket side wall surface portions and the leg side wall surface portions are oblique.

7. A plastic pallet comprising:

a planar platform structure; and a plurality of downwardly extending legs of closed box configuration spaced about the periphery of the platform structure and each including an outboard wall structure having a lower portion and an upper portion recessed inboard with respect to the lower portion;

the platform structure defining a perimeter and a peripheral downwardly extending lip defining a downwardly opening groove extending around the perimeter of the platform structure;

the upper portion of the wall structure of each leg being spaced inboard from the lip so as not to encroach upon the groove; and the groove being defined at least in part between the lip and the upper portion of the wall structure.

8. A plastic pallet according to claim 7 wherein:

the platform structure defines a plurality of downwardly opening pockets; and each leg has an upper end fitted into a respective pocket and fused to the platform structure.

9. A plastic pallet according to claim 8 wherein:

the pallet further includes a planar base structure;

the base structure defines a plurality of upwardly opening pockets in the upper face of the base structure; and the lower end of each leg is positioned in a respective pocket and fused to the base structure.

10. A plastic pallet comprising:

a planar platform structure; and a plurality of downwardly extending legs of closed box configuration spaced about the periphery of the platform structure and each including an outboard wall structure having a lower portion and an upper portion recessed inboard with respect to the lower portion;

the platform structure defining an outer perimeter and the lower portion of the wall structure of each leg being positioned approximately flush with the outer perimeter of the platform structure.

11. A plastic pallet comprising:

a planar platform structure; and a plurality of downwardly extending legs of closed box configuration spaced about the periphery of the platform structure and each including an outboard wall structure having a lower portion and an upper portion recessed inboard with respect to the lower portion;

the platform structure defining an outer perimeter and a peripheral downwardly extending lip defining a downwardly opening groove extending around the outer perimeter of the platform structure;

the upper portion of the wall structure of each leg being spaced inboard from the lip so as not to encroach upon the groove;

the pallet further including a planar base structure defining an outer perimeter and having a size and configuration approximating the size and configuration of the platform structure; and the lower ends of the legs being secured to an upper face of the base structure with the lower portions of the outboard wall structures of the legs positioned approximately flush with the outer perimeter of the base structure.

* * * * *